United States Patent [19]

Morton

[11] 3,992,721

[45] Nov. 23, 1976

[54] SAFETY HELMET WITH INDIVIDUALIZED HEAD-CONTOURED INTER-LINER

[76] Inventor: William G. Morton, P.O. Box 841, Hopewell, Va. 23860

[22] Filed: Apr. 23, 1975

[21] Appl. No.: 570,712

Related U.S. Application Data

[63] Continuation-in-part of Ser. No. 360,950, May 16, 1973, Pat. No. 3,882,546, which is a continuation-in-part of Ser. No. 323,195, Jan. 12, 1973, which is a continuation of Ser. No. 805,299, March 7, 1969, abandoned.

[52] U.S. Cl. ..... 2/3 R; 128/89 A; 264/222; 425/2

[51] Int. Cl.[2] ..... A42B 3/00

[58] Field of Search ..... 128/89, 90; 264/46.5, 264/46.9, 222, DIG. 30; 2/3 R, 6; 425/2

[56] References Cited

UNITED STATES PATENTS

| | | | |
|---|---|---|---|
| 2,324,420 | 7/1943 | Oestrike | 264/DIG. 30 |
| 2,901,751 | 9/1959 | Gales et al. | 2/209 X |
| 2,908,943 | 10/1959 | Miller | 2/3 R |
| 3,563,234 | 2/1971 | Umstead | 264/222 |
| 3,726,620 | 4/1973 | Morton | 264/222 |
| 3,882,546 | 5/1975 | Morton | 2/3 R |

*Primary Examiner*—Werner H. Schroeder
*Assistant Examiner*—Conrad L. Berman
*Attorney, Agent, or Firm*—Jacox & Meckstroth

[57] ABSTRACT

A substantially rigid dome-shaped shell encloses a deformable cap-like headpiece of uniform thickness. The headpiece conforms to the contour of the wearer's head and cooperates with the shell to define a dome-shaped cavity which is sealed around its bottom portion. The cavity is filled with an expandable plastics foam material which conforms to the contour of the headpiece. In one embodiment, spacer members are positioned within the cavity and extend from the headpiece to the shell for positioning the shell relative to the headpiece, and in another embodiment, the shell is spaced within a slightly larger outer shell by resilient energy-absorbing foam pads. In a further embodiment, the headpiece is formed by stretching a piece of leather with a device having a predetermined contour.

7 Claims, 16 Drawing Figures

FIG-7
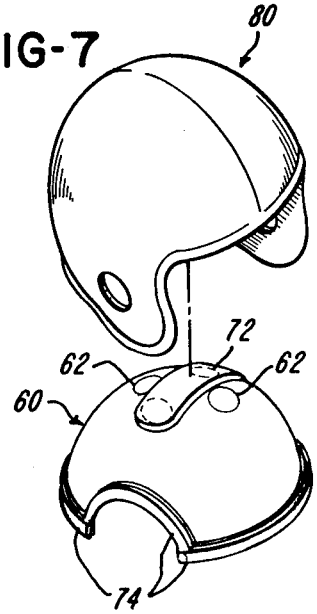
FIG-8
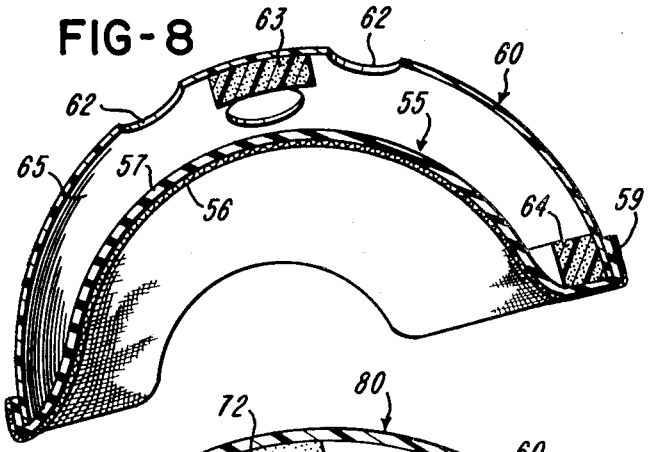
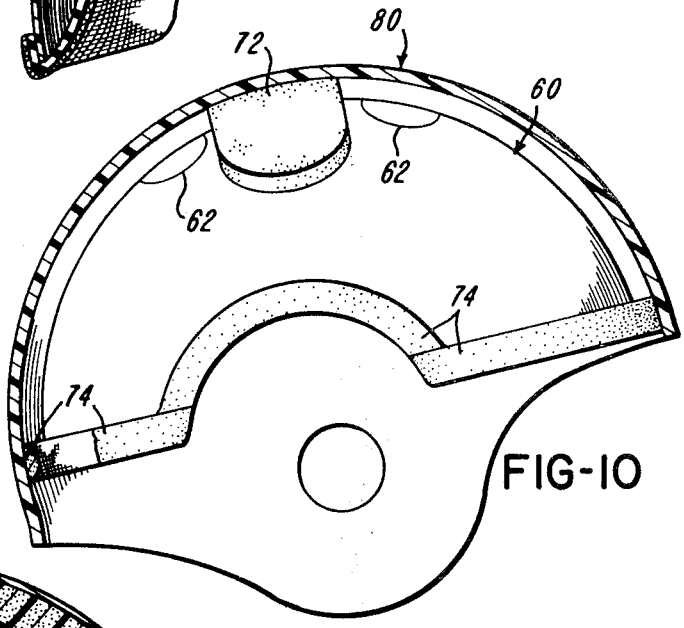
FIG-10
FIG-9
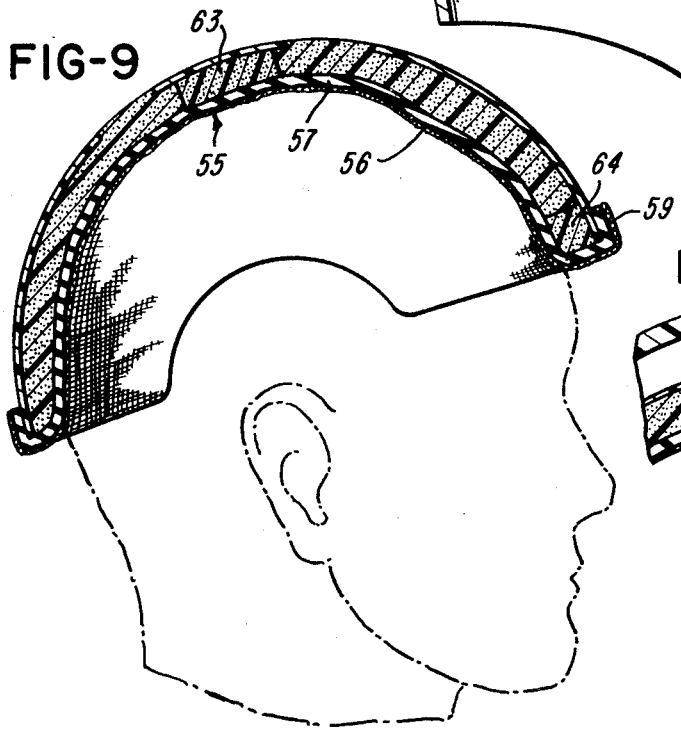
FIG-11
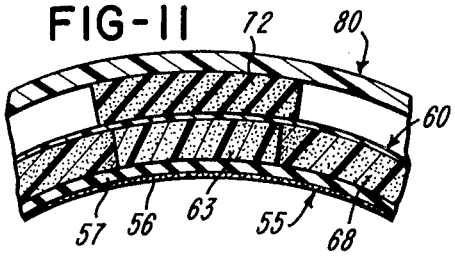

SAFETY HELMET WITH INDIVIDUALIZED HEAD-CONTOURED INTER-LINER

RELATED APPLICATIONS

This application is a continuation-in-part of copending application Ser. No. 360,950 filed May 16, 1973, now issued as U.S. Pat. No. 3,882,546, which is a continuation-in-part of Ser. No. 323,195, filed Jan. 12, 1973, which is a continuation of application Ser. No. 805,299 filed Mar. 7, 1969, now abandoned.

BACKGROUND OF THE INVENTION

This invention is in the field of safety helmets having form-fitting protective headgear liners and their fabrication. Protective headgear or safety helmets are well known and used in many fields of endeavor such as firefighting, construction work, police work, and sports as well as by aircraft crew members. For example, U.S. Pats. Nos. 2,901,750; 2,901,751, 2,908,943, 3,320,619 and 3,413,656 disclose safety helmets of various constructions.

In many instances, it is advantageous to have a liner which may be inserted between a hard outer protective shell and the individual wearer's head and which will fit snugly and conform exactly to the shape of the wearer's head. One such instance is in the case of an aircraft crew member who, in the course of his duty, is subjected to very large fluctuations in gravity pull. In the past, off the shelf type headgear or helmets worn by aircraft crew members have not had form-fitting liners and have tended to move from side to side or from back to front (or the reverse) when the wearer was subjected to fluctuations in gravitational pull. Such headgear movements have been known to cause injury to the wearer.

Methods have been devised for fabricating form-fitting headgear liners. These methods have required that a mold of the wearer's head be prepared before fabrication of the liner can be accomplished. The required mold-making and other complicated steps required in the prior art have caused the methods to be time consuming and expensive. Furthermore, liners prepared by the prior art methods have tended to be heavy and thus uncomfortable to the wearer.

SUMMARY OF THE INVENTION

The present invention is directed to a safety helmet which incorporates a lightweight, inexpensive and form-fitting protective headgear liner which can be quickly fabricated by anyone given a small amount of equipment. The method requires as equipment a cover or deformable headpiece for the wearer's head, such as a bathing cap commonly worn by female swimmers, a flexible dam which will fit tightly around the wearer's head just below the desired lower level of the form-fitting liner, to fill the space between the head and lower rim of a rigid outer shell. Also required is a forming agent or expandable plastics foam material from which the liner is made. In one embodiment, the lower edge portion of the deformable headpiece is attached to the lower edge portion of the helmet shell, and spacers are used to position the shell relative to the headpiece before the space is filled with the foam material. In another embodiment the headpiece and shell assembly are positioned within a slightly larger outer shell by energy absorbing pads. The use of the foregoing equipment and the construction of the safety helmets will become apparent from the reading of the following description of the preferred embodiments and from the accompanying drawings.

BRIEF DESCRIPTION OF THE DRAWINGS

FIG. 7 is an exploded perspective view of a safety helmet constructed in accordance with another embodiment of the invention;

FIG. 8 is a vertical section through the inner helmet shell and headpiece assembly shown in FIG. 7 prior to receiving the expandable foam material;

FIG. 9 is a section similar to FIG. 8, but taken after receiving the foam material, and illustrating its foam-fit to an individual's head;

FIG. 10 is a side elevational view of the inner shell and headpiece assembly shown in FIG. 7 and showing its position within the outer helmet shell also shown in FIG. 7;

FIG. 11 is an enlarged fragmentary section taken through the top portion of the helmet assembly shown in FIG. 10;

DESCRIPTION OF THE PREFERRED EMBODIMENTS

Figure 1:
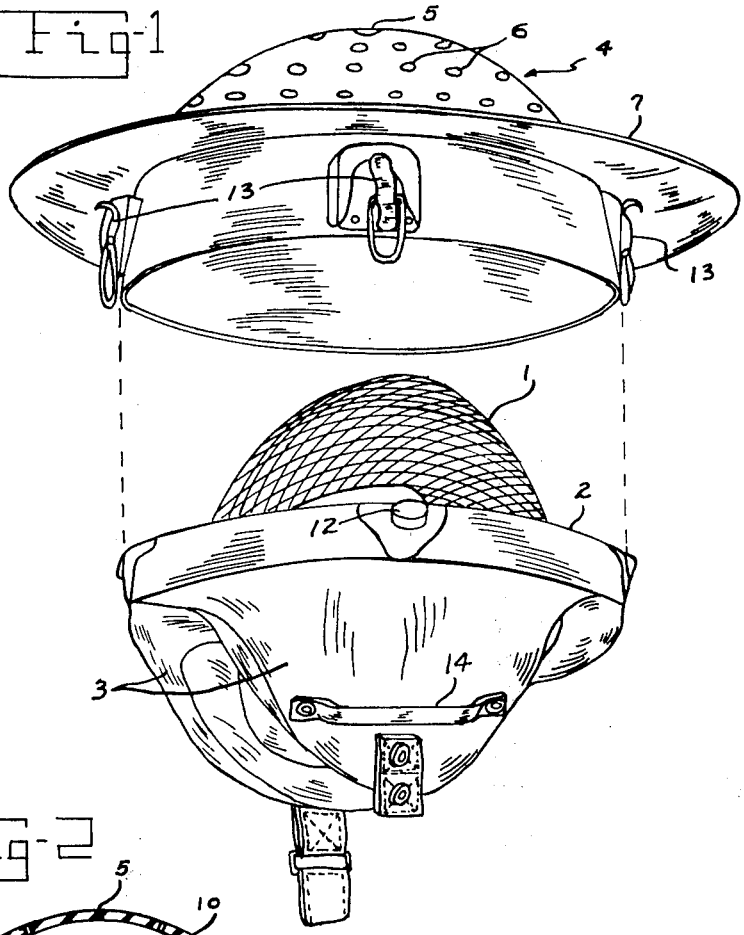
FIG. 1 is a view of the dam and attached headpiece of this invention and shows a rigid outer shell spaced above the dam and headpiece.
Figure 2:
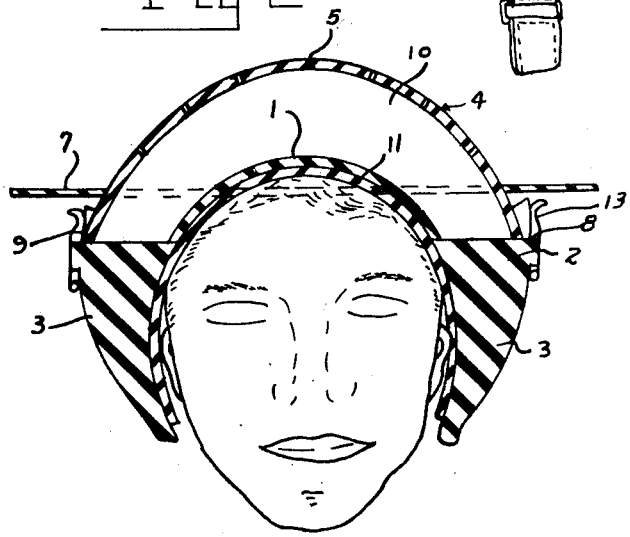
FIG. 2 is a cutaway view showing dam, headpiece, and outer shell placed on an individual wearer's head prior to a foaming operation.

Referring to FIGS. 1 and 2, the head of the individual wearer is used as a perfect mold for that individual's form-fitting, protective headgear liner. A dam, which may be constructed of flexible foam rubber or an inflatable rubber bladder or any other material which will allow the dam to fit snugly between the wearer's head and the lower rim of an outer shell, is placed on the wearer's head. A suitable dam 2 is shown in FIG. 1 of the drawing. The dam 2 shown by FIG. 1 is constructed with two tightly fitting ear flaps 3 which serve to protect the wearer's ears during the foaming operation described later. FIG. 1 also shows a tightly fitting soft rubber headpiece 1 over the top of the wearer's head.

A bathing cap of the type commonly worn by female swimmers is perfectly suitable as a headpiece 1. The bathing cap should be glued, or attached in some manner, to the inner headband portion of the dam to prevent foaming agent from flowing through during the later described foaming operation.

FIG. 1 of the drawing also shows a dome-shaped outer shell 4 to be placed over the dam 2 of FIG. 1. The outer shell 4 should be the top portion of a protective headgear for which a form-fitting inner liner is desired. For example, if one wishes to prepare form-fitting inner liners for aircrew headgear, one needs simply to remove the portions which normally cover the ears from one headgear, drill one large opening 5 of about ¾ inch diameter in the top center of the crown and several small openings 6 of aboout 3/16 inch diameter around the perimeter of the crown, and one has an outer portion of a mold which is suitable for the preparation of many form-fitting liners. FIG. 1 shows a brim 7 attached to the outer shell 4. The brim is simply to prevent any foaming material from running over on to the wearer during the foaming step. The large hole 5 is drilled for the purpose of allowing a foaming material to be poured in, and the small holes 6 are to allow sufficientt air to escape during the foaming action, thus, allowing the foaming agent to fill the entire cavity between the wearer's head and the inside of the protective headgear outer shell.

FIG. 2 shows the dam 2 with ear flaps 3 and headpiece 1 placed on a wearer's head. FIG. 2 also shows the outer shell 4 placed over the dam 2. Points 8 and 9 and all points around the dam therebetween are of particular interest. The outer shell should fit snugly against dam 2 at points 8 and 9 and all points between 8 and 9 around the outer perimeter of the dam 2. The number 10 is used to designate an open space or dome-shaped cavity defined between the headpiece 1 and the inside of outer shell 4.

To fabricate a form-fitting liner, one simply places the apparatus shown by FIG. 1 together on the head of the wearer as shown in FIG. 2 and fills cavity 10 with a foaming material through large opening 5 and waits for the material to foam. When placing the apparatus on a wearer's head, care should be taken to smooth down the headpiece 1 and eliminate all air bubbles thereunder. Care should also be taken to adjust the apparatus in a comfortable position on the wearer's head because, once fabricated, the form-fitting liner will be fairly rigid and its shape will not be readily adjustable. Male member 12 and female member 13 of clips suitable for fastening the apparatus together are shown by FIG. 1. The handle 14 is simply to facilitate placing of the apparatus on the wearer's head.

There are many chemical agents or compounds available commercially which, when appropriately mixed, agitated or otherwise activated will react to form a rigid or semirigid foam substance. Any materials, compounds, liquids or combination thereof which, when appropriately activated, will create a foam to give the properties desired for the use intended is suitable. Certain of the compounds used in the plastics industry are particularly suited for this purpose. It is preferable that the foaming agent should foam without too great an exotherm. Temperatures above about 130° F are uncomfortable to the wearer since the wearer has only a thin headpiece between his head and the foam while the foaming action is taking place.

If one wishes to cover the fabricated form-fitting liner with soft leather or some other material, after it has been fabricated, one may fabricate another head cover of the same thickness as the leather to be used and place this second head cover on the wearer's head under the headpiece 1 while the foaming operation is being carried out. This second head cover may be fabricated from an insulating material to protect the wearer's head from any excess heat that may be generated by the foaming action. If this is done, the permissible foaming action exotherm may be greatly increased. A second headpiece 11 is shown on the wearer's head in FIG. 2 of the drawing.

More than one large opening 5 may be drilled in the crown of the outer shell 4. The number of small openings 6 drilled in the upper crown of the outer shell will effect the density of the foam liner. Generally, the more holes, the less dense will be the finished foam liner. The numbers of small openings may be varied from 6 to 60 or more depending on the final density desired.

Before carrying out the foaming operation described above, all parts of the apparatus which will come into contact with the foam should be coated with a parting agent such as silicone rubber. This will facilitate removal of the foamed form-fitting liner from the head and the outer shell.

It has been stated above that there are chemical agents commerically available which will produce suitable foams and that temperatures created around the wearer's head by the foaming action should not exceed about 130° F. Experimentation has shown that the formulation disclosed in the following example will produce an excellent final product. This formulation is not, to the best of the inventor's knowledge, available commercially.

A foaming material suitable for use in the practice of this invention may be prepared and used in the following manner. First, component I consisting of 190 grams of diphenylmethane diisocyanate and 21 grams of trichloromonofluoromethane is mixed in a first container. Second, component II consisting of 160 grams of a polyoxypropylene polyol having an average molecular weight of about 425, 2.4 grams of silicone glycol copolymer having an average molecular weight in the range of about 750 to 3000, 48 grams of trichloromonofluoromethane, and .52 gram of dibutyl tin diaostate is mixed in a second container. After mixing, component I and component II are poured together in a 1 to 7 ratio by weight and allowed to start a bubbling action. As soon as the bubbling action begins, a suitable amount of the mixed components is poured through large opening 5 of the apparatus which has been previously fitted together as shown by FIG. 2 of the drawing. The foaming formulation described herein will foam to give a form-fitting headgear liner which is very light and of excellent color and strength. The foaming action described herein produces a gas that is somewhat toxic. Thus, the foaming step should be carried out in a well ventilated area.

It should be emphasized here that the foaming agent disclosed herein is not the only foaming agent which may be used in practicing this invention. Any foaming agent may be used which forms to give the properties desired and which does not produce temperatures above that which can be tolerated by the individual wearer. Shielding may be utilized if a foaming agent with a high exotherm is used. It should also be emphasized that, although a headgear liner for a headgear which will be worn by an aircrew member is used as the example in this specification, form-fitting headgear liners have applications in many other fields of endeavor.

Another embodiment of this invention should be pointed out. In all of the specification hearabove it has been assumed that the rigid outer shell was to be used over and over again as the outer portion of a mold for form-fitting inner liners. Now let us consider the case of an individual wearer who wishes to use his own headgear as the outer portion of a mold. This wearer could simply procure a dam, a bathing cap, a foaming agent, and his own headgear as the necessary materials for practicing this invention. He could then drill one or more openings in the top of his own headgear shell, remove any padding spacers, headband or other fitting devices which he had previously used, place a bathing cap, a dam and the headgear shell on his head as described above, and carry out the foaming step. The wearer would then have his own personal headgear shell fitted with a form-fitting liner inside of it. The wearer would never have to remove the liner from inside of the headgear.

Referring to FIGS. 3–6 which show another protective headgear or safety helmet constructed in accordance with the invention, a dome-shaped helmet shell 25 includes a top portion 26 and depending ear portions 27 which are integrally molded of a substantially rigid plastics material. A set of four openings or holes 29 are formed within the top portion 26, and a spacer pad 31 (FIG. 4) is attached to the inner surface of the helmet shell 25 adjacent the hole 29 by a suitable adhesive. Preferably, the spacer pad 31 is formed of a rigid expanded foam material such as polyurethane or the foam material referred to above. Another spacer pad in the form of an elongated band 32 is attached to the forward edge portion of the shell 25 adjacent the lower edge of the shell.

A deformable or stretchable cap-like headpiece 35 is positioned within the shell 25 and has a lower peripheral edge portion 37 which is attached to the lower peripheral edge portion of the shell 25 by a suitable adhesive. The headpiece 35 also includes depending ear portions 38 (FIG. 6) which are bonded by adhesive to the inner surfaces of the corresponding ear portions 27 of the helmet shell 25. The annular ear pieces commonly used, are not shown for purposes of simplification. Preferably, the headpiece 35 consists of a stretchable or elastic layer 39 of resilient rubber foam material, for example, such as the material manufactured and produced by Uniroyal, Inc. marketed under the trademark Ensolite. This material also includes a stretchable woven fabric 41 which is bonded or laminated to the layer 39 of foam rubber material.

Figure 3:
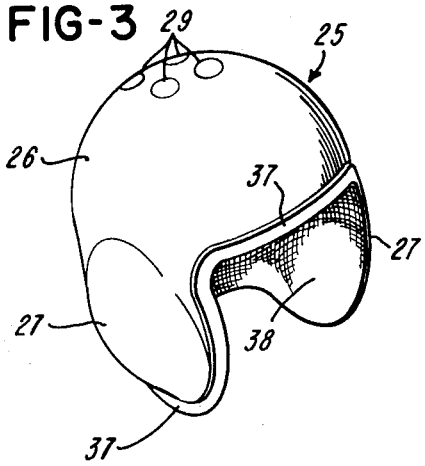
FIG. 3 is a perspective view of a safety helmet constructed in accordance with another embodiment of the invention.
Figure 4:
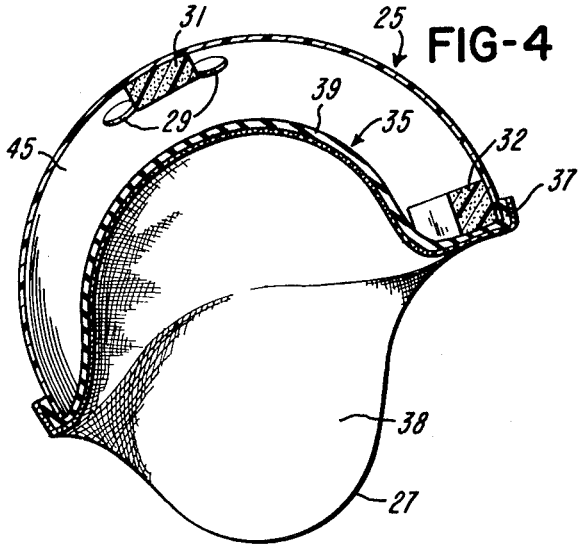
FIG. 4 is a vertical section of the helmet shown in FIG. 3 prior to receiving the expandable foam liner material.
Figure 5:
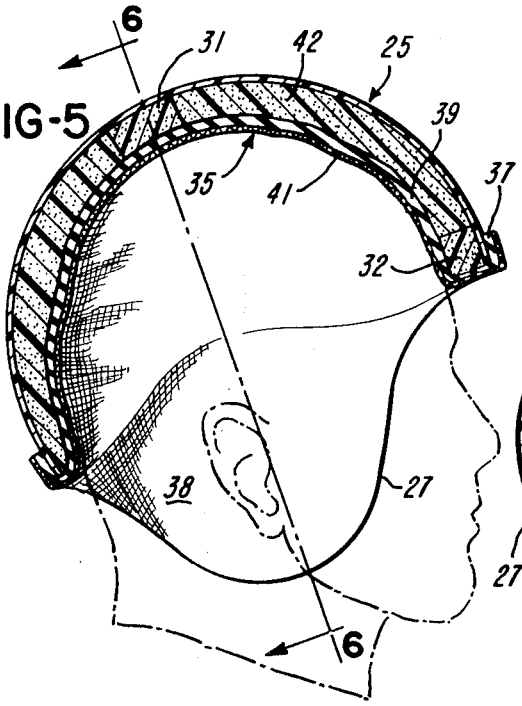
FIG. 5 is a vertical section of the completed safety helmet shown in FIG. 3 and illustrating its form-fit to an individual's head.
Figure 6:
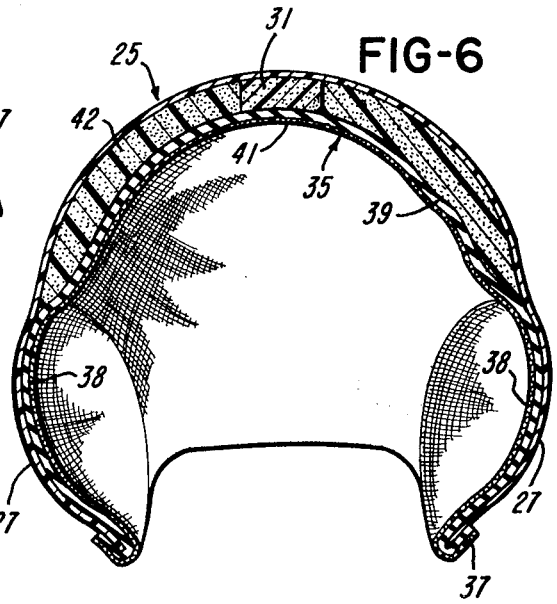
FIG. 6 is a section of the safety helmet assembly as generally taken on lines 6—6 of FIG. 5.
Figure 12:
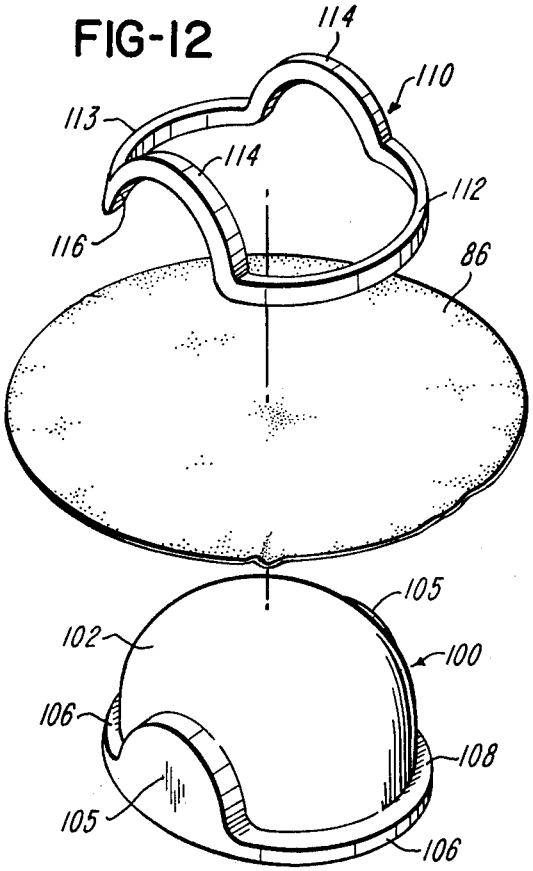
FIG. 12 is an exploded perspective view of a stretching device for forming a headpiece for the safety helmet assembly shown in FIGS. 7–11.

The final step in constructing the safety helmet shown in FIG. 3, includes positioning the assembly of the helmet shell 25 and the headpiece 35 on the head of the individual who is to wear the helmet. The shell 25 is pressed downwardly causing the headpiece 35 to stretch into a tight-fitting conforming relation to the contour of the individual's head and until the headpiece abuts the spacer members or pads 31 and 32, as shown in FIG. 5. An expandable polyurethane foam material 42 or the foam material described above in connection with FIGS. 1 and 2, is poured into the dome shaped cavity 45 through one or more of the holes 29 so that after the material expands, the entire cavity 45 is filled with the foam material 42 as shown in FIGS. 5 and 6. The expansion of the foam material also assures that the deformable or stretchable headpiece 35 is pressed firmly against the individual's head and thereby assures a perfect fit of the headpiece 35 to the contour of the head.

Referring to FIG. 7-11 which show a safety helmet constructed in accordance with another embodiment of the invention, a deformable or stretchable headpiece 55 (FIG. 8) is constructed of the same material as described above in connection with the headpiece 35, including a stretchable woven fabric 56 which is laminated or bonded to a layer 57 of foam rubber material so that the headpiece 55 has a uniform thickness. The lower peripheral edge portion 59 of the cap-like headpiece 55 is attached by adhesive to the lower peripheral edge portion of a substantially rigid dome-shaped inner helmet shell 60 (FIG. 8) in the same manner as the peripheral edge portion of the headpiece 35 is attached to the peripheral edge portion of the helmet shell 25, referred to above in connection with FIG. 4. The shell 60 also includes a set of four openings or holes 62 similar to the helmet shell 25 and supports corresponding rigid foam spacer pads 63 and 64 in the same manner as the spacer pads 31 and 32 are supported by the inner surface of the helmet shell 25. Preferably, the inner helmet shell 60 is formed of a substantially rigid plastics material such as a thin layer of molded fiberglass.

The assembly of the headpiece 55 and inner helmet shell 60 is placed on an individual's head (FIG. 9) so that the deformable headpiece 55 stretches until it abuts the spacer pad 63 and 64. The dome-shaped cavity 65, defined between the headpiece 55 and shell 60, is then filled with an expandable foam material 68 in the same manner as mentioned above in connection with FIG. 5. After the foam material 68 sets and hardens, a pad 72 (FIG. 7) of high energy absorbing resilient foam material is attached by adhesive to the top surface of the inner shell 60, and a band 74 of the same material is attached by adhesive to the turned up lower peripheral edge portion 59 of the headpiece 55, as shown in FIG. 7.

The helmet liner assembly including the headpiece 55, shell 60 and resilient spacer pad 72 and band 74, is positioned within an outer helmet shell 80. Preferably, the outer shell 80 is molded of a rigid plastics material in the same manner as the helmet shell 25 discussed above in connection with FIG. 3–6. The helmet liner assembly is secured within the helmet shell 80 by adhesive which attaches the resilient spacer pad 72 and band 74 to the inner surface of the shell 80.

Figure 13:
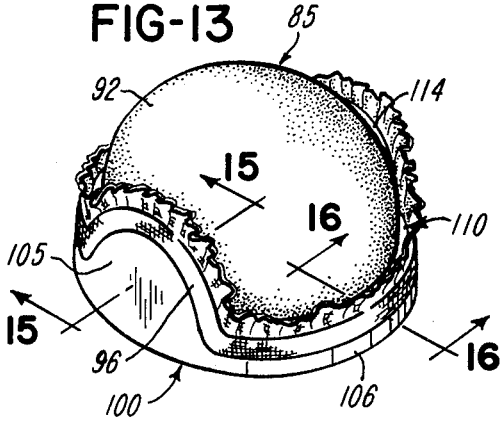
FIG. 13 is a perspective view of the stretching device shown in FIG. 12 and illustrating the forming of a headpiece.
Figure 14:
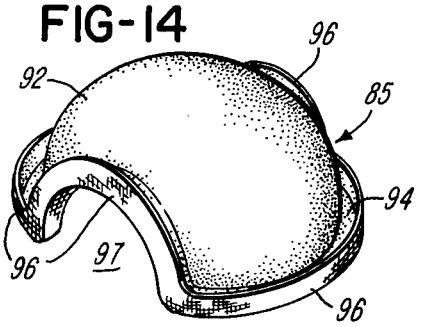
FIG. 14 is a perspective view of the headpiece shown in FIG. 13 after it is removed from the stretching device and is trimmed.
Figure 15:
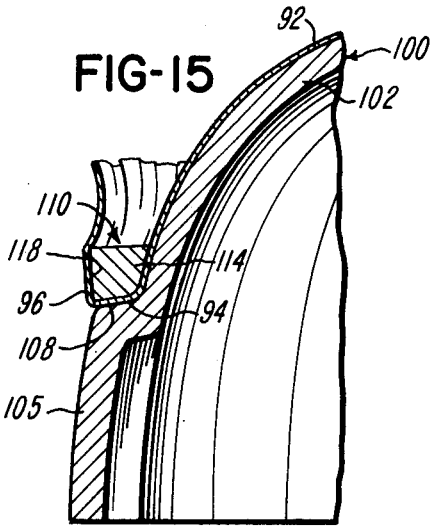
FIG. 15 is an enlarged fragmentary section of the stretching device, taken generally along the line 15—15 of FIG. 13.
Figure 16:
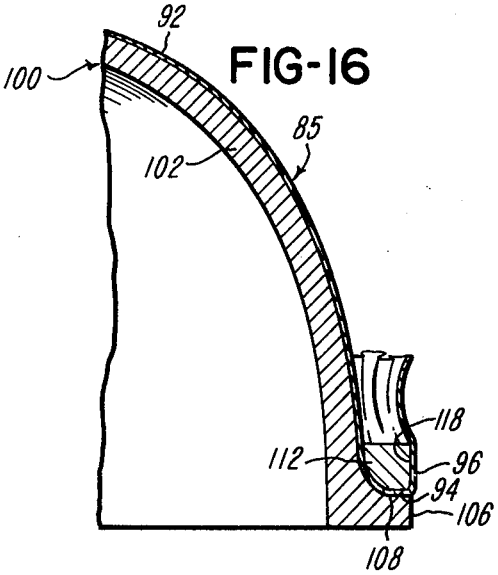
FIG. 16 is a fragmentary section similar to FIG. 15 and taken generally on the line 16—16 of FIG. 13.

Referring to FIGS. 12–16, the inner deformable headpiece 35 (FIG. 5) or the headpiece 55 (FIG. 9) may be replaced by a deformable cap member or cap-like headpiece 85 (FIG. 14) which is formed by stretching a single piece 86 (FIG. 12) of leather. In a manner similar to the headpiece 55, the headpiece 85 includes a dome-shaped head covering portion 92, peripherally extending and outwardly projecting flange portion 94, and a peripherally extending band portion 96 which projects upwardly from the flange portion 94. As illustrated in FIG. 14, the flange portion 94 and band portion 96 project or curve upwardly in an inverted U-shaped manner on opposite sides of the dome-shaped portion 92 to define corresponding arch-like recesses 97. The band portion 96 of the headpiece 85 is adapted to be attached by a suitable cement to the lower conforming edge portion of a dome-shaped helmet shell such as the helmet shell 60 described above in connection with FIGS. 7-11.

The cap-like leather headpiece 85 is formed by stretching the piece 86 of leather with a stretching device which includes a first or base mold member 100 having a dome-shaped mold surface 102. The mold member 100 also includes a pair of inverted U-shaped bosses 105 which project outwardly from opposite sides of the mold surface 102 and cooperate with an outwardly projecting base flange 106 to form a correspondingly shaped peripheral surface or shoulder 108 which is connected by a curved surface to the mold surface 102.

The stretching device also includes a second or upper mold member 110 which is preferably constructed in the form of a metal frame adapted to seat on the base mold member 100. The upper mold member 110 includes a set of opposing U-shaped horizontal portions 112 and 113 which are integrally connected by a pair of inverted U-shaped vertical portions 114. The portions 112-114 have a continuous inner annular or peripheral forming surface 116 which has a cross-sectional curvature conforming to the inner curvature of the shoulder 108 of the base mold member 100. The portions 112-114 of the mold member 110 also have an outer peripheral surface 118 which extends generally vertically from the inner forming surface 116.

In the process of stretching the leather piece 86 to form the headpiece 85, the leather piece 86 is soaked in warm water and placed between the mold members 100 and 110. While the outer peripheral edge portion of the piece 86 is being tensioned outwardly, the mold members 100 and 110 are compressed together as illustrated in FIG. 13. The outer peripheral edge portion of the leather piece 86 is then tensioned or pulled upwardly adjacent the outer peripheral surface 118 of the upper mold member 110. This process causes the leather piece 86 to stretch into the configuration shown in FIG. 13, forming the head covering portion 92, the outwardly projecting flange portion 94 and the upwardly projecting band portion 96 of the headpiece 85. The stretched leather piece 86 is allowed to dry while it is being clamped between the mold members 100 and 110. After drying, the upwardly projecting peripheral edge portion of the piece 86 is trimmed to form the headpiece 85 wherein the band portion 96 has a generally smooth upper edge conforming to the contour of the upper mold member 110, as shown in FIG. 14.

From the drawings in the above description, it is apparent that a safety helmet constructed in accordance with the present invention provides desirable features and advantages. One primary feature is that the invention provides for conveniently and quickly producing an individualized safety helmet which significantly increases the safety for the wearer's head. This increased safety is caused by having an inner liner which conforms to the contour of the wearer's head and which significantly distributes an impact force more uniformly over an area of the head. The contoured liner also substantially shifting of the helmet on the wearer's head in addition to providing a high strength - light weight construction so that the helmet can be conveniently and comfortably worn for extended periods of time.

The embodiment shown in FIGS. 3–6 provides for efficiently producing the helmet for an individual's head. That is, the assembly of the rigid shell 25 and stretchable headpiece 35 are simply positioned on an individual's head and held downwardly while the cavity 45 is filled with a expandable plastics foam material. The embodiment shown in FIGS. 7–11 provides for significantly increasing the impact resistance and safety of the helmet by incorporating a rigid inner helmet shell 55 spaced within a rigid outer helmet shell 80. In addition, the resilient foam pad 72 and band 74 not only provide for absorbing energy produced by an impact on the outer shell 80 but also provide for accommodating outer helmet shells 80 of different sizes and configurations, simply by using resilient pads 72 and bands 74 of different thicknesses. The dual rigid shell construction is especially desirable for withstanding the blow of a pointed object. That is, if the pointed object has sufficient momentum to pierce the outer shell 80, the inner rigid shell 55 provides a secondary barrier for resisting further travel of the object.

As another feature, the headpiece 85, which is formed or stretched from a single piece of leather, provides a smooth inner surface which conforms to the contour of the wearer's head when the foam material is expanded within the dome-shaped cavity defined between the headpiece and the surrounding helmet shell. Furthermore, the leather headpiece cooperates with the expanded rigid foam material to provide for the "breathing" of air through the headpiece and form material.

While the foams of safety helmets herein described constitute preferred embodiments of the invention, it is to be understood that the invention is not limited to these precise forms of helmets, and that changes may be made therein without departing from the scope and spirit of the invention.

The invention having thus been described, the following is claimed:

1. An improved safety helmet assembly adapted to be individualized to a wearer's head for distributing impact forces substantially uniformly over the head, comprising a substantially rigid dome-shaped shell, a deformable one-piece dome-shaped stretched leather cap member of substantially uniform thickness and positioned within said shell to define a dome-shaped cavity therebetween, said cap member being effective to receive the wearer's head and to conform to the contour of the head over the entire area covered by said cap member, said cap member having an outwardly projecting and peripherally extending integral flange portion forming a lower edge portion, means for connecting said lower edge portion of said cap member to the corresponding lower edge portion of said shell and forming a fluid-tight seal around the bottom of said cavity, means defining an opening extending to said cavity to provide for introducing a fluid expandable plastics foam material into said cavity after said cap member and said shell are positioned on the wearer's head, said cavity being filled with a substantially rigid expanded plastics foam material, and said material having an inner surface conforming to the contour of said cap member and the wearer's head.

2. A safety helmet assembly as defined in claim 1 wherein said cap member and said flange portion defines a pair of side recesses extending upwardly within said shell and over the ears of the wearer's head.

3. A safety helmet assembly as defined in claim 1 wherein said cap member further includes a peripherally extending band portion projecting upwardly within said shell from said flange portion.

4. A safety helmet assembly as defined in claim 3 wherein said flange portion and said band portion of said cap member define a pair of side recesses extending upwardly within said shell and over the ears of the wearer's head.

5. An improved safety helmet assembly adapted to be individualized to a wearer's head for distributing impact forces substantially uniformly over the head, comprising a substantially rigid dome-shaped shell, a deformable dome-shaped headpiece of substantially uniform thickness and positioned within said shell to define a dome-shaped cavity therebetween, said headpiece being effective to receive and cover a substantial area of the wearer's head and to conform to the contour of the head over the entire area covered by said headpiece, means for connecting a lower edge portion of said headpiece to the corresponding lower edge portion of said shell and forming a fluid-tight seal around the bottom of said cavity, means defining an opening extending to said cavity to provide for introducing a fluid expandable plastics foam material into said cavity after said headpiece and said shell are positioned on the wearer's head, said cavity being filled with a substantially rigid expanded plastics foam material, and said material having an inner surface conforming to the contour of said headpiece and the wearer's head.

6. An improved safety helmet assembly adapted for distributing impact forces substantially uniformly over a wearer's head, comprising a substantially rigid dome-shaped outer shell, a dome-shaped inner shell disposed within said outer shell, a deformable dome-shaped headpiece of substantially uniform thickness and spaced within said inner shell to define a dome-shaped cavity therebetween, said headpiece being effective to receive and cover the wearer's head and to conform to the contour of the head over the entire area covered by said headpiece, said headpiece having an outwardly projecting and peripherally extending integral flange portion forming the lower edge portion of said headpiece, means for connecting said flange portion of said headpiece to the corresponding lower edge portion of said inner shell around the bottom of said cavity, and said lower edge portions of said headpiece and said inner shell define a pair of side recesses extending upwardly within said outer shell and over the ears of the wearer's head.

7. An improved safety helmet assembly adapted to be individualized to a wearer's head for distributing impact forces substantially uniformly over the head, comprising a substantially rigid dome-shaped shell, a one-piece cap member of stretch leather and positioned within said shell to define a dome-shaped cavity therebetween, said cap member being effective to receive the wearer's head and to conform to the contour of the head over the entire area covered by said cap member, said cap member having an integral peripherally extending and outwardly projecting bottom flange portion, means for connecting said flange portion of said cap member to the corresponding lower edge portion of said shell and forming a fluid-tight seal around the bottom of said cavity, means defining an opening extending to said cavity to provide for introducing a fluid expandable plastics foam material into said cavity after said cap member and said shell are positioned on the wearer's head, said cavity being filled with a substantially rigid expanded plastics foam material, and said material having an inner surface conforming to the contour of said cap member and the wearer's head.

* * * * *